United States Patent [19]

Dananberg

[11] Patent Number: 4,597,195

[45] Date of Patent: Jul. 1, 1986

[54] HUMAN SHOE SOLE

[76] Inventor: Howard J. Dananberg, 700 Maple St., Manchester, N.H. 03104

[21] Appl. No.: 598,712

[22] Filed: Apr. 11, 1984

[51] Int. Cl.[4] ..... A43B 13/18

[52] U.S. Cl. ..... 36/28; 36/43

[58] Field of Search ..... 36/31, 43, 44, 28, 25 R, 36/30 R, 30 A, 32 R, 95, 88, 103, 91

[56] References Cited

U.S. PATENT DOCUMENTS

| | | | |
|---|---|---|---|
| 1,480,234 | 1/1924 | Wedd . | |
| 2,055,072 | 9/1936 | Everston | 36/28 X |
| 2,897,611 | 8/1959 | Schaller | 36/44 X |
| 2,909,854 | 10/1959 | Edelstein | 36/43 X |
| 2,928,193 | 3/1960 | Kristan | 36/44 X |
| 4,377,041 | 3/1983 | Alchermes | 36/31 X |
| 4,472,890 | 9/1984 | Gilbert | 36/28 |
| 4,494,321 | 1/1985 | Lawlor | 36/28 |

FOREIGN PATENT DOCUMENTS

| | | | |
|---|---|---|---|
| 660551 | 5/1938 | Fed. Rep. of Germany | 36/31 |
| 1163646 | 4/1958 | France | 36/88 |
| 2522482 | 9/1983 | France | 36/28 |

*Primary Examiner*—Henry S. Jaudon
*Assistant Examiner*—T. Graveline
*Attorney, Agent, or Firm*—Hayes, Davis & Soloway

[57] ABSTRACT

A human shoe sole has a foot engaging surface, that area of the sole immediately underlying the first metatarsal head being designed so that the first metatarsal head is free to plantarflex under load thus permitting and encouraging the first metatarsal to plantarflex as weight shifts from the heel to the toe during walking.

13 Claims, 10 Drawing Figures

THE WINDLASS EFFECT

HUMAN SHOE SOLE

The present invention relates to a new and improved design associated with the construction of a human shoe sole capable of encouraging the human great toe to be able to extend on the first metatarsal head. This design can be used in any shoe sole where walking or athletics are performed.

Prior to the present invention, various shoe sole designs were known, but none of the same lend themselves to the advantages and overall efficiencies achievable in conjunction with the present invention.

It is in the context of the above that one of the primary objects of the present invention is to create a new and improved design of the human shoe sole whereby the human first metatarsal will be able to achieve a plantarflexed position relative to the great toe and the remaining metatarsal heads. This plantarflexed position will thereby allow for the extension of the human great toe during the human gait cycle in an efficient fashion.

It is also the purpose of this invention to create a variable density human shoe sole whereby the human shoe sole will cause a selective decrease in the ground reactive force under the head of the first metatarsal such that the muscle, namely the peroneous longus, will be relatively strengthened and exert a greater plantarflexory force on the first metatarsal.

It is additionally the purpose of this invention to create a variable density human shoe sole that will prevent the human first metatarsal-phalangeal joint from locking when in fact, metatarsal-phalangeal joint toe extension should be occurring during the human gait cycle.

SUMMARY OF THE INVENTION

The present invention is designed to allow the first metatarsal and hallux (great toe) to function in their proper sequence. It is their sequential function that seems to control not only the toe-off phase but the shape of the arch and tne ability of the foot to spring forward as well. The invention effectively encourages this proper functioning and preferably comprises a lower durometer (by comparison to the remaining midsole) material placed directly under the first metatarsal head in a cutout of the original mid-sole material. The shape of the cutout is one where the portion underlying the medial sesmoid is wider than the portion underlying the lateral sesmoid. Because the durometer rating of the insert plug is less than the remaining midsole material, the reactive force of the ground under this particular site is decreased relative to the remainder of the foot. This allows for a relative strengthening of the peroneous longus and a stabilizing effect on the foot by causing the first metatarsal to bear weight while plantarflexing against the ground. The peroneous longus muscle originates from the head of the fibular on the lateral aspect of the leg and proceeds distally down the leg behind the lateral malleolus or outside portion of the ankle. It then courses medially under a groove in the cuboid and inserts into the medial plantar portion of the medial cuneiform and base of the first metatarsal. Its function during stance is to plantarflex and evert the first ray and stabilize the medial side of the foot against the ground. Not only does the softer cutout of the present invention promote plantarflexion of the first metatarsal, but also (due to the varying width of the cut out) promotes eversion of this same bone. Once the initial motion of first metatarsal plantarflexion-great toe extension begins to take place, the mechanical advantage of the proximal phalynx over the metatarsal is such that the first metatarsal can no longer dorsiflex under weight bearing conditions. This allows for the windlass effect (described by Hicks) to take place; the arch raises as the heel lifts off the ground and therefore provides better support to the body.

In consideration of the above, a description of the human gait follows. Normal walking consists of two distinct phases: stance phase and swing phase. Stance phase can be divided into three component parts: (1) contact, (2) foot flat or midstance, and (3) propulsion. When one limb is beginning the stance phase, the other is concluding stance and initiating swing. There has been much confusion as to the foot's role in gait. For years it had been thought that the foot moved down, or plantarflexed, to propel us forward. That, of course, would mean that the foot was acting as a lever arm, similar to the way a crow bar works. When the foot is viewed in respect to the rest of the body, however, it is really too small to do that effectively. The body is simply too large to be propelled in that fashion. In reality, it is the leg and thigh that act as the lever, not the foot. Using the length provided between hip and ankle, we can create a lever effect against the ground, forcing the ground behind us. Since the ground does not move, we instead cause the body's center of gravity, or middle, to advance in the forward direction. Since it is the foot that is in contact with the ground, its purpose is to create the maximum amount of longitudinal shear, or backwards thrust necessary to push us forward. In order to accomplish this, the foot is able to undergo a motion known as supination. Supination is a triplanar motion that occurs on all three cardinal planes of the body. These are known as the frontal, Saggital, and Transverse Planes. The motions that occur are Inversion, Plantarflexion, and Adduction and take place at the Subtalar Joint. The Subtalar Joint is located beneath the ankle joint at the interface of the Talus and the Calcaneous and is made up of three articular facets which can allow for this three-way movement. This motion allows for the foot to be extremely stable under weight bearing conditions with the axis of the rear foot joint (subtalar joint) becoming perpendicular to the axis of the midfoot (midtarsal joint). This allows for stability on the part of the medial longitudinal arch. The foot undergoes this supinatory motion from the end of the contact phase of gait through the midstance and then propulsion phase. It then enters the swing phase of gait and is in the supinated position so that at contact, it can go through the opposite motion of pronation. Pronation, like supination, is a triplaner motion taking place at the Subtalar joint. Its direction of movement is opposite of supination and is comprised of Eversion, Dorsiflexion, and Abduction occuring on the same cardinal planes. It is the motion of pronation that the subtalar joint uses to absorb the contact shock related to heel strike at the onset of the contact portion of the stance phase of gait. It then proceeds to go through the same mechanics once again and creates the necessary backwards thrust to propel the body. Much of the power for this backwards thrust is created through the swing phase limb. Just as a child on a swing pumps his legs to gain height, ours pulls our body forward much like a car with front wheel drive. By combining this motion with opposite arm swing, the body develops an anterior driving force that is capable of near perpetual motion. In the text "Neural Control of Locomotion" edited by Dr. Richard Herman (publ. 1976) this forward driving force of the swing limb is described. Dr. Herman has explained that in studies of all types of patients, both normal and abnormal, the swing phase activity of humans is nearly identical regardless of body type. It therefore can be assumed that it is the weight bearing limb that interferes with the perpetual motion that most humans are capable of creating.

A new system for computerized gait analysis, known as the Electrodynogram has been developed by the Langer Biomechanics Laboratory of Deer Park, New York and approved for clinical use by the FDA. The Langer Electrodynogram is in essence a variable vertical load analyzer. It consists of seven sensors per foot with six occupying predetermined sights on the plantar surface of the foot. The seventh or "X" sensor is designed to be used on any particular sight desired. The standard application points are: H=Hallux (or great toe), 1=First Metatarsal head, 2=Second Met Head, 5=Fifth Met Head, M=Medial Heel, and L=Lateral Heel. I have found it most advantageous to utilize the 1 and X sensors in a slightly different way. The 1 is placed beneath the Tibial Sesmoid (medial first Metatarsal head) and the X is placed under the Fibular Sesmoid (lateral first Metatarsal Head). In this fashion, it is possible to determine the direction of motion of the lst Metatarsal and therefore, understand its relationship to the remainder of the foot. Dr. Merton Root et al in the Journal of the American Podiatry Association in December, 1982 states that the "first ray functions about an independent axis that allows motion primarily in the frontal and saggital planes producing inversion with dorsiflexion and eversion with plantarflexion." Using this information, the conclusion can be drawn that the vertical force exerted on the fibular (lateral) portion of the first metatarsal head during the early part of metatarsal weight bearing and before peak weight bearing, will be greater as the first metatarsal dorsiflexes and it will be greater on the tibial (medial) portion as the first metatarsal plantarflexes. Therefore, when the X sensor values are greater than the 1 sensor values the metatarsal is dorsiflexing and when the 1 sensor values are greater than the X, the metatarsal is plantarflexing. The pressure exerted on the sensors is interpreted by the Electrodynogram system and the computer generates seven force/time curves for each foot. These curves are displayed for each foot on a graph with the vertical axis being force and the horizontal axis being time. Evaluation of the curves can be performed on a variety of different levels depending on the nature of the test being conducted. For the purpose of this discussion, we are interested in understanding the nature of stress flowing through the weight bearing bones of the foot, relative to time.

In independent research that I have performed using the Langer Electrodynogram, one of the most glaring abnormalities noted has been FUNCTIONAL HALLUX LIMITUS. Hallux Limitus is a well-known medical entity and can be defined as a deformity in the first metatarsal phalangeal joint in which the Hallux is unable to move to the dorsum of the first metatarsal head when extending at the first metatarsal-phalangeal joint. Patients may present with erythema, edema and pain in and around the great toe joint. There is an inability to fully extend the Hallux during examination. There is evidence of joint narrowing on X-ray along with osteophyte formation on the dorsal, dorso-medial and dorso-lateral surface of the joint. Functional Hallux Limitus is a different type of entity. The definition of Hallux Limitus only applies during stance. Pain may or may not be present in the joint and the first metatarsal-phalangeal joint may or may not be readily associated with the patient's chief complaint. The signs of joint wear or destruction present in Hallux Limitus are not necessarily present in Functional Hallux Limitus. In the static exam there appears to be adequate dorsiflexion range of motion available, yet for variable periods of time while walking, no extension of the great toe takes place. In the text, "Normal and Abnormal Function of the Foot" by Merton Root, William Orien and John Weed, (publ. 1977) the etiology of Hallux Limitus is described. It is an inability of the first ray to stabilize against the ground causing a dorsiflexion range of motion to take place on weight bearing. When the first ray dorsiflexes on weight bearing the base of the proximal phalynx collides with the head of the first metatarsal thereby locking the first metatarsal phalangeal joint and preventing hallux extension. The etiology of Functional Hallux Limitus appears to be the same. This locking of the great toe joint, even for a brief period of time, causes many compensations to take place in the foot and prevents the aponeurosis activation of the supination mechanism. In 1954, J. H. Hicks, in the Journal of Anatomy, described what he referred to as the WINDLASS EFFECT (FIG. 9) of the plantar aponeurosis. The plantar aponeurosis is a structure that runs from the plantar tuberosity of the calcaneous in a distal fashion with five slips inserting into the base of the proximal phalynx of each toe. The thickest and strongest portion inserts onto the great toe and the slips progressively decrease in thickness and strength in digits two (2) thru five (5) with the fifth being almost nonfunctional. During digital extension, the aponeurosis literally wraps around the metatarsal heads functionally shortening the distance between them and insertion point onto the calcaneous. Effectively, what this causes, is a raising of the arch and a supination of the foot. Since it is the insertion to the great toe which is the largest, it is at the first metatarsal-phalangeal joint where the greatest force is exerted. This mechanism is described by Hicks as completely independent of muscle function and works well in a living foot as in a cadaver specimen. When FUNCTIONAL HALLUX LIMITUS is present, pronation continues through mid stance as supination has failed to be initiated through Hallux extension and problems of overuse ensue. Additionally when the first metatarsal phalangeal joint locks the effect can be one of forefoot pronation. Since the first metatarsal's lever arm's functional length has been increased by the length of the Hallux, it now can overpower the plantargrade pull of the peroneous longus on the first metatarsal. This results in a dorsiflexory motion of the first ray and a secondary pronation of the foot. The stability of the Talo-navicular joint and its ability to maintain the integrity of the medial longitudinal arch is dramatically decreased. Additionally, it is the inability of hallux dorsiflexion that prevents the smooth transfer of weight from heel to toe through the bones of the foot and thereby prevents "perpetual motion" from taking place.

COMPARISONS TO PRIOR ART

For many years, the search for the best method of support with a human shoe has continued. Attempts have been made to limit rear foot pronation by varieties of means. In U.S. Pat. No. 4,364,188 Turner et al have added stabilization means to the medial portion of the hindfoot midsole. Other similar methods of dual density material uses have been attempted. In U.S. Pat. No. 4,316,332 Giese et al have added different lower density materials to both the rear and forefoot components of the midsole in order to aid in shock absorption. In U.S. Pat. No. 4,377,041 Alchermes uses a lower durometer bar placed under the metatarsal-phalangeal joints in order to increase the flexibility of the shoe at that site. In U.S. Pat. No. 2,863,231 Jones uses raised sponge rubber pads under metatarsal heads 1 and 5 and a thicker sponge pad under metatarsal heads 2, 3 and 4 as a means of forefoot support and the pad dorsiflexes the first and fifth metatarsal heads. All the above-mentioned concepts have, in one way or another, attempted to use some form of external support and/or shock absorbtion mechanism to stablize the human foot. The present invention, however, creates an environment which encourages the intrinsic mechanisms of the human foot to support itself. By allowing for proper great toe extension at toe-off, the self-supporting effect of the windlass mechanism as described by Hicks and referred to in this description can be utilized by the human foot. When proper supination is accomplished by the windlass, not only is the foot able to better support the weight of the body during the midstance and propulsion phases of gait, but it also is in the correct position to begin the contact phase which occurs at the conclusion of the swing phase. The greater the supination at propulsion, the more pronation range of motion is available for attenuation of impact shock at heel contact.

DETAILED DESCRIPTION OF THE INVENTION

In order to more fully understand the invention, reference should be had to the following drawings taken in connection with the accompanying text which shows several preferred forms of the invention:

Figure 5:
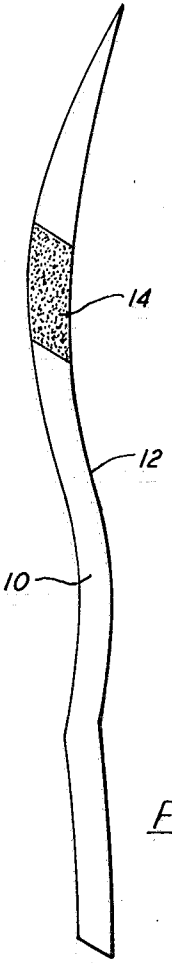
Figure 5A:
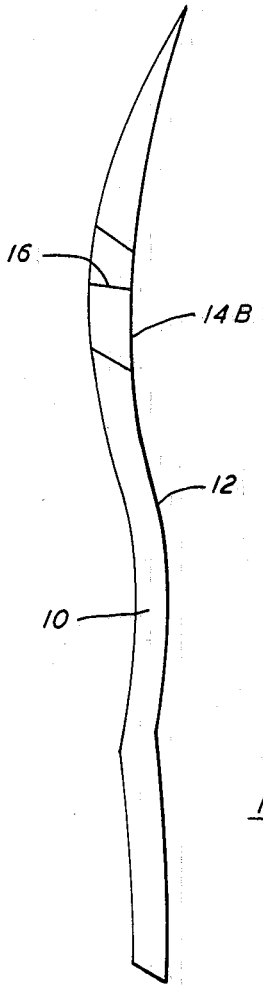

FIG. 5*a* is a view similar to FIG. 5 showing another modification of the invention.

Figure 7:
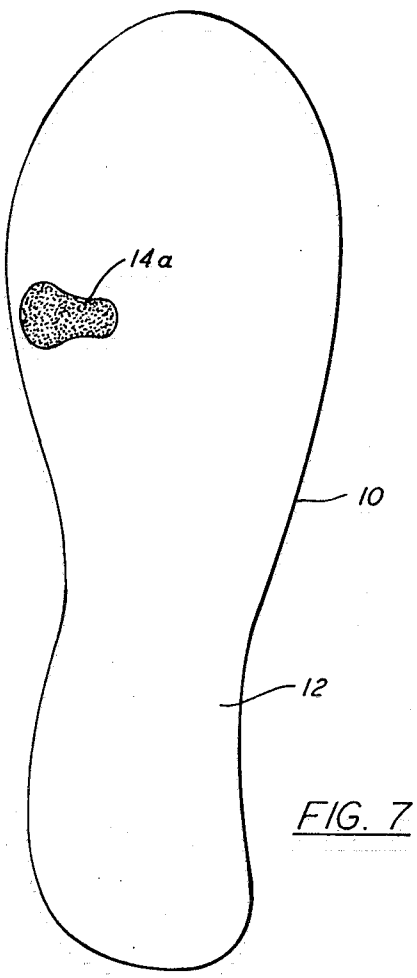
Figure 8:
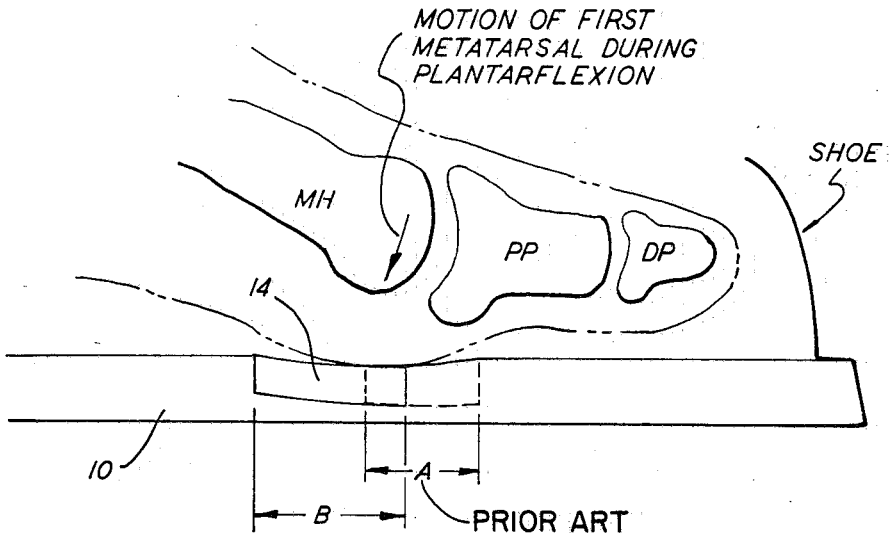
Figure 9:
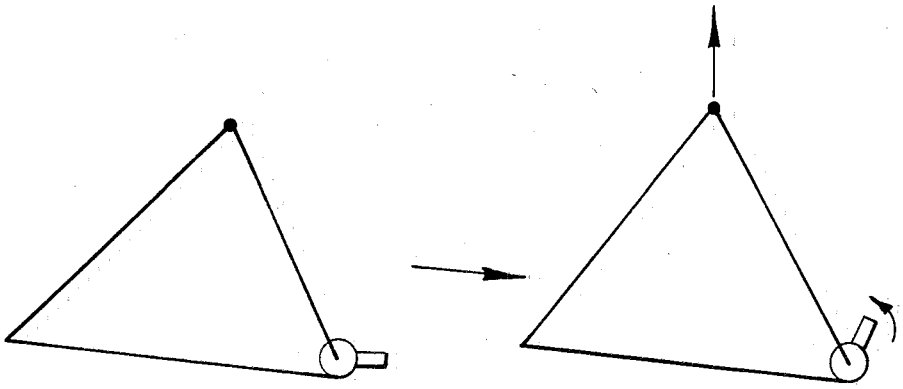

FIG. 7 illustrates another embodiment of the present invention;

FIG. 8 is a sectional view of a shoe showing a schematic diagram of a first metatarsal head with its relationship to the lower durometer portion of the sole of the present invention. This also shows the prior art as represented by the U.S. Pat. No. 4,377,041, to Alchermes, and the difference between the present invention and the prior art.

and, FIG. 9 illustrates the windlass effect described in the Journal of Anatomy by J. H. Hicks in 1954 with respect to planar aponeurosis.

Figure 1:
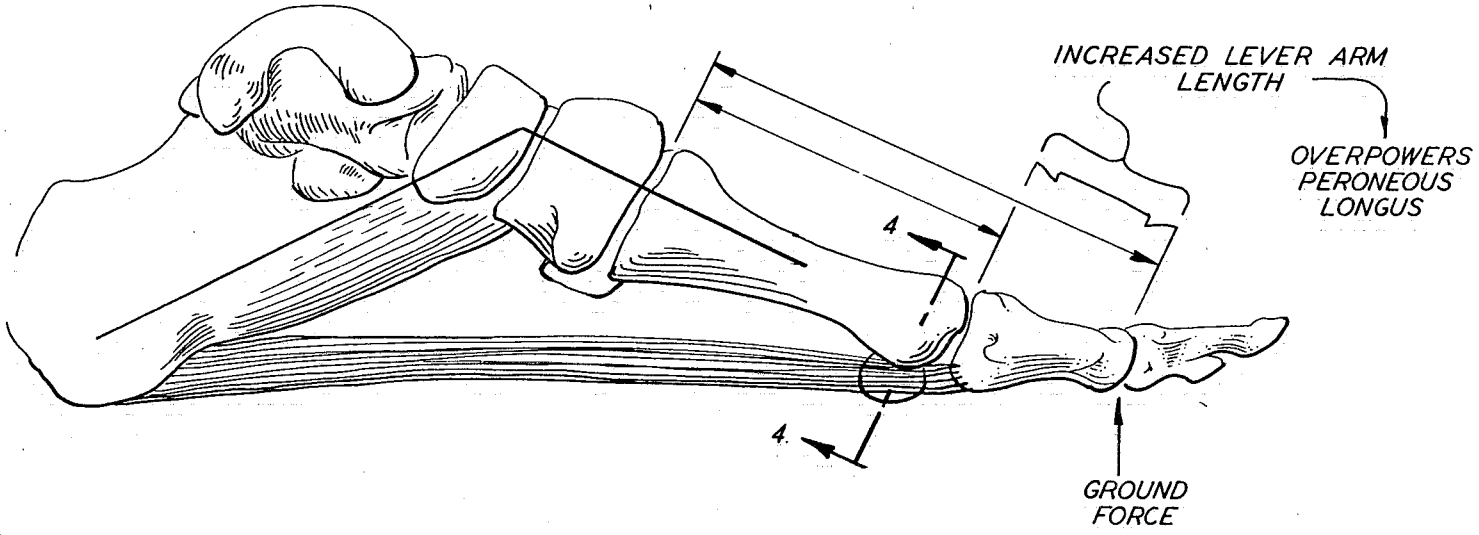
FIG. 1 is a diagrammatic, schematic diagram of the foot as it might be seen in an X-ray showing additional soft tissue structures.
Figure 2:
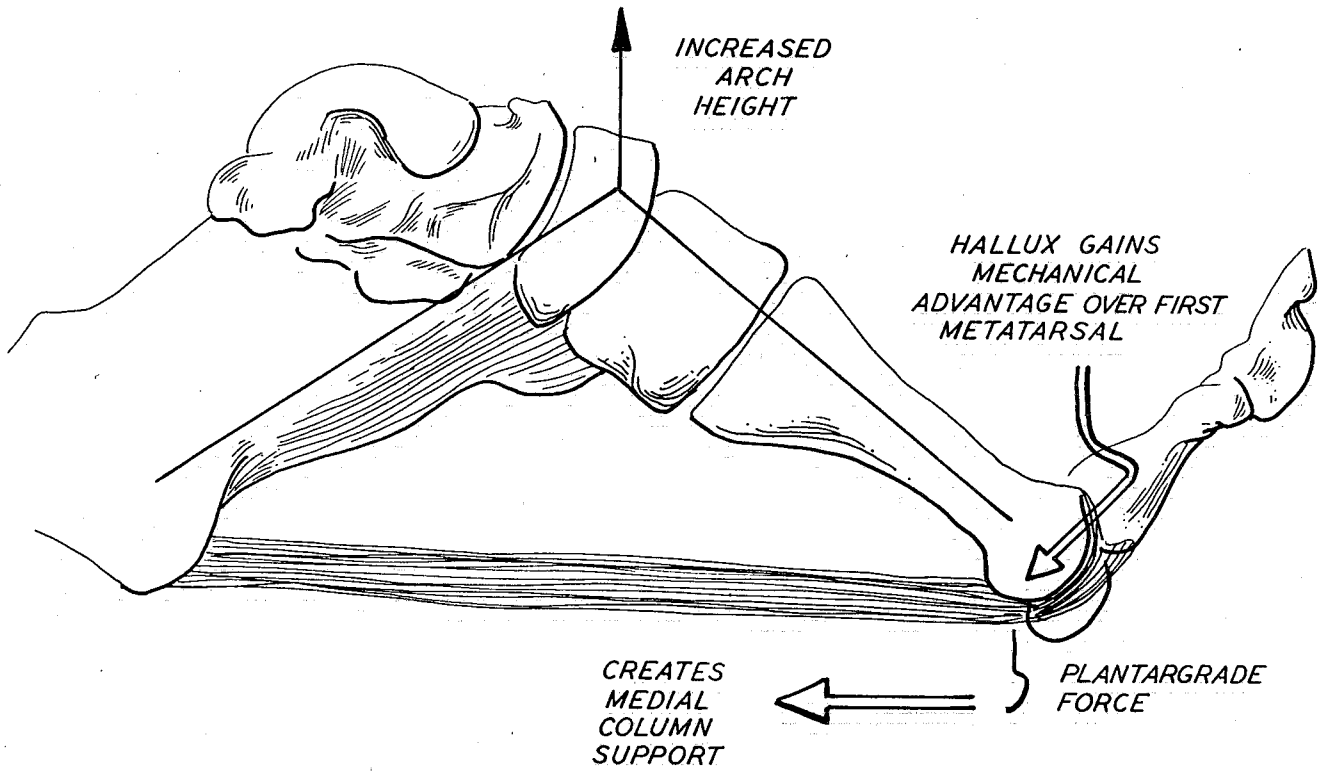
FIG. 2 is a view similar to FIG. 1 showing the foot as it should effectively function.
Figure 3:
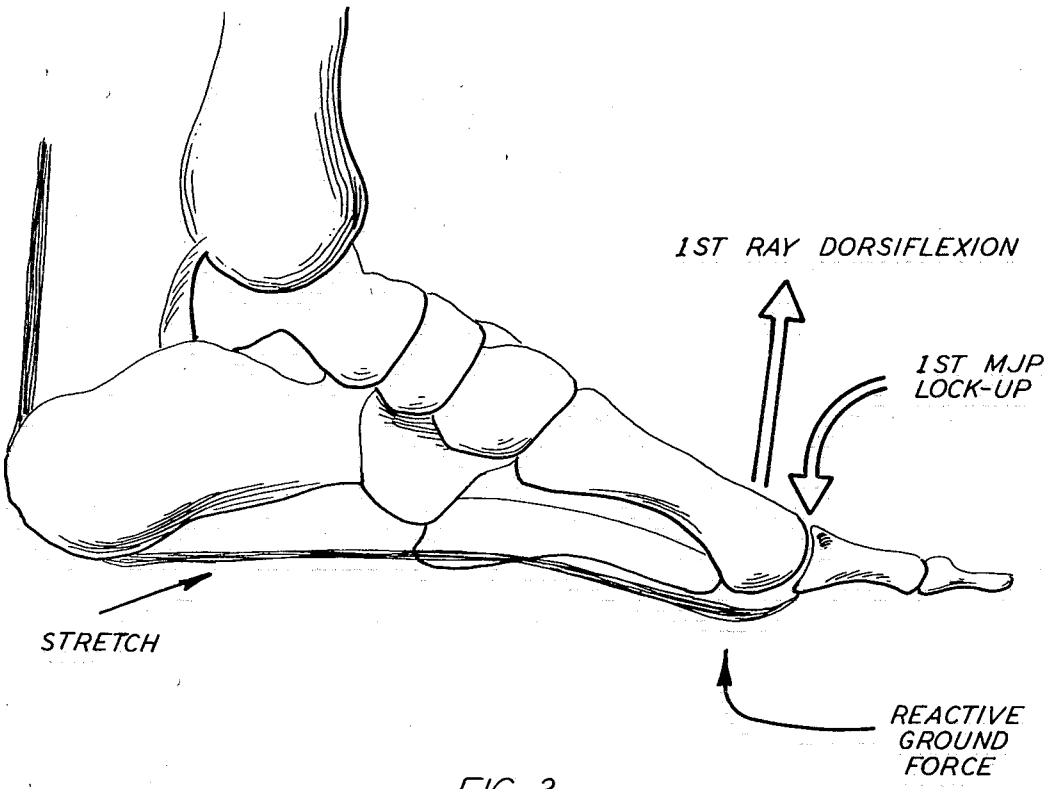
FIG. 3 shows first ray dorsiflexion and the problem of first metatarsal phalangeal joint lock up.

Reviewing again the motions of the bones of the foot, reference should be had to FIGS. 1 through 4. To determine the actual motion of the first metatarsal head experiments were made using the Electrodynogram referred to above to show how the vertical forces exerted on the two sesmoids of the metatarsal head can create eversion or inversion and thus encourage or discourage, as the case may be, the dorsiflexion or plantarflexion of the first metatarsal. As weight begins to shift from the heel to the first metatarsal head it is critical that plantarflexion be permitted. This means that the first metatarsal head must be permitted to move downward and to rotate to the medial (evert) or inside (See FIG. 4-*c* and also see FIG. 2 showing the plantarflexion of the foot). As can be seen, relative forward motion of the sesmoids and plantarflexion of the first metatarsal for tightening the plantar aponeurosis and therefor create the windlass effect described by Hicks.

Figure 4:
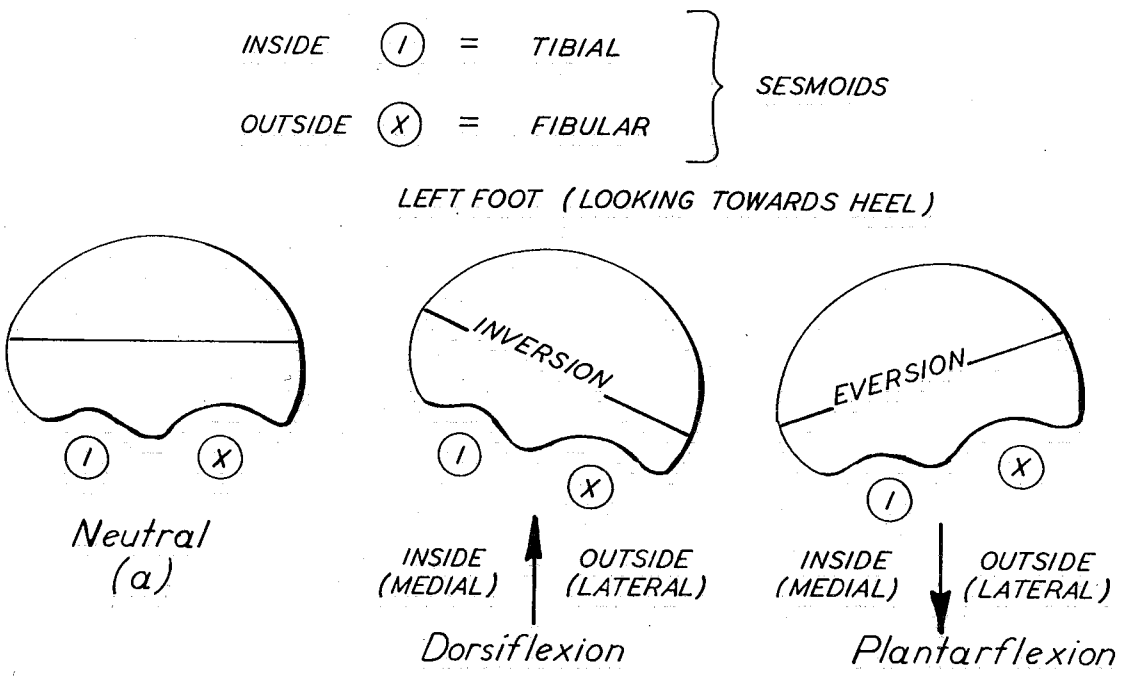
FIG. 4 is a section taken along the line 4—4 of FIG. 1 of a left foot showing the inversion and eversion motions of the head of the first metatarsal.
Figure 6:
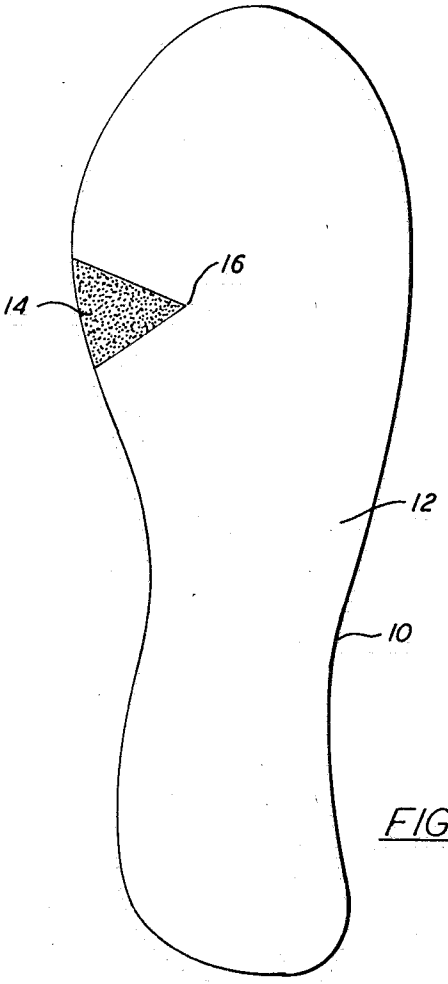
FIG. 5 is a sectional view of one shoe sole embodying the present invention and FIG. 6 is a plan view of the shoe sole of FIG. 5.

Referring now more specifically to FIGS. 5 and 6, there is shown a shoe sole embodying one preferred form of the invention. The sole is indicated at 10 as having a smooth upper surface 12 and an insert 14 of a material which is softer than the material of the remainder of the sole. As can be seen, this portion tapers outwardly from a point 16 to a relatively wide portion at the inside of the foot. This softer section 14 is positioned under the head of the first metatarsal and the transverse increase in softness encourages eversion and plantarflexion of the first metatarsal head as weight shifts from the heel to the first ray. Thus the normal functioning of the foot for plantarflexion and supination will be encouraged with beneficial results for walking and for shock absorption on subsequent heel contact. As can be seen in FIG. 4-*c*, the softer portion of the insert 14, (i.e. the wider portion) is positioned to contact the inside or medial portion of the first metatarsal head and encourages this first metatarsal head to plantarflex and evert, thus encouraging the normal plantarflexion shown in FIG. 2.

Referring now to FIG. 7 there is shown another embodiment of the invention wherein the insert 14-*a* is shown in plan view as having a slightly larger area under the medial portion of the first metatarsal head.

Referring now to FIG. 8, the relationship of the insert 14 in the sole 10 with respect to the bones of the first ray is shown. In this FIG. 8, the insert is shown at 14 as encompassing the range B. As can be seen, the normal motion of the first metatarsal head, with its sesmoids, causes it to move down and slightly to the rear where it will impinge directly on the area encompassed by B. This permits the natural motion of the first metatarsal head with the plantarflexion and desired eversion. Also, superimposed on this drawing is a dotted line area, shown as A, which represents the invention of Alchermes U.S. Pat. No. 4,377,041. As described in his patent this softer section of Alchermes is for the purpose of permitting flexing of the sole of the shoe, not for plantarflexion of the first metatarsal head. Accordingly, this flexible section is in front of the head, towards the toe and is positioned under the joint between the first metatarsal head and the proximal phalynx. This will do nothing to encourage metatarsal plantarflexion since it will not encourage downward motion of the first metatarsal head with respect to the remainder of the bones in the first ray. It is this downward motion or plantarflexion and eversion (as weight transfers from the heel to the metatarsal head) which is of critical importance in the present invention.

In a preferred form of the invention, the cutout 14 can be made of ethylene vinyl acetate foam, for example, having a durometer of 45 which can be used in a shoe sole having a durometer of 50 for the remainder of the sole. The principal point here is that the durometer of the insert be appreciably softer than the durometer of the surrounding portions of the sole so that transfer of the weight from the heel to the first ray will tend not to push the first metatarsal head up, and thereby start the natural action of plantarflexion and eversion.

While one preferred embodiment has been described above, numerous embodiments may be employed as long as they accomplish the desired promotion of natural plantarflexion of the first metatarsal head. Numerous other materials of different density may be employed. The same result can be achieved by providing a hollow instead of a lower durometer material. Such a form of the invention is shown in FIG. 5*a* wherein the insert 14 is removed leaving a space 14*b* having the same size and shape as that normally occupied by insert 14. When there is a hollow underneath the first metatarsal head the transfer of weight causes the first metatarsal head to move naturally into the hollow, thus starting the plantarflexion with continued plantarflexion and eversion providing proper toe-off. The hollow need not be very large and its depth will, of course, depend upon the hardness of the adjacent sole. When the adjacent sole is fairly hard, such as with a leather dress shoe sole, the hollow under the first metatarsal head can be quite shallow on the order of a few sixteenths of an inch. When the adjacent sole is softer, and there is more compression of the sole as the weight shifts from the heel to the first ray, then the hollow should be deeper to assure that the natural motion of the first metatarsal head in a plantarflexing direction is not impeded, but is encouraged.

While the invention has been described as a shoe sole, it can be equally employed as an insole and wherever the word "sole" is used it should be interpreted to mean "insole" as well.

MEDICAL PROBLEMS OF FUNCTIONAL HALLUX LIMITUS

As discussed in detail above, inability of the first metatarsal head to plantarflex can bring about the condition referred to as Functional Hallux Limitus, the effects of which can be far removed from the great toe joint.

COMPENSATION FOR FUNCTIONAL HALLUX LIMITUS

A variety of compensations exist for the inability of the great toe to extend during gait. The true cause of why some patients develop hallux limitus while others compensate for the inability of the great toe to extend is still not clearly understood. The compensatory mechanisms that will be discussed are a result of clinical observation. The use of the Langer Biomechanics Laboratory Electrodynagram has been a major factor in the differentiation of these compensations.

FOREFOOT INVERSION

If the hallux cannot dorsiflex on the first metatarsal as heel lift is initiated, then forefoot inversion may take place. Weight is shifted to the lateral bones of the metatarsus prior to toe-off and the step is either completed from the lateral segment or the lateral segment bears weight for prolonged periods of time which prove to be far in excess of normal. Since the forefoot cannot invert independently of the rearfoot, this particular method of compensation takes place along with subtalar supination. The same muscular structures that supinate the rearfoot are used to invert the forefoot.

SYMPTOMS

Because the first metatarsal phalangeal joint's inability to extend is being compensated for, pain may or may not be present in the first metatarsal phalangeal joint. Pain can generally be present in and around the areas of the second, third or fourth innerspace or metatarsal head and radiate or be felt into the sulcus. The availability of first metatarsal phalangeal joint extension seems inversely proportional to the location of the pain. The more hallux extension decreases, the more forefoot inversion increases. Neuroma or neuroma-like symptoms may be present. Pain and or numbness can be felt on the lateral aspects of the foot. Pain about the lateral aspect of the foot in and about the area of the cuboid or about the lateral ligamentous structures of the ankle may be present. The patient may complain that this is as a result of trauma in the form of sprained ankle yet the pain has existed in a chronic nature for some time. (Although foot dysfunction may not be enough to cause problems initially, once a problem has developed it is certainly possible that the chronic nature of this particular dysfunction can prevent adequate healing from taking place.) The patient may also have complaints of chronic ankle spraining as well.

EARLY TOE-OFF

If adequate range of motion of the first metatarsal phalangeal joint does not exist then premature toe-off can occur. The time factor involved in a premature toe-off can usually be measured only in milliseconds. However, its effect on the creation of longitudinal shear force as described earlier, appears to be significant and although locally asymptomatic, functional hallux limitus can in fact induce muscular overuse and therefor overuse symptoms.

SYMPTOMS

Early toe-off can be accomplished through premature contraction of the anterior tibial and extensor muscles of the lower leg. Normally the anterior tibial will fire prior to toe-off to assist in foot dorsiflexion and toe clearance of the ground. Overuse of this muscle can take place if it is needed to fire for a longer period of time due to early ground clearance. Symptoms for this particular compensation often exist with pain in the anterior lateral aspect of the lower leg. Pain most often exists after the conclusion of activity. Patients will complain of rest pain in the evening and occasionally will describe being awakened at night through cramping and/or leg pain while in bed. Additional symptoms may also include pain in the groin and pain across the iliac crest in the low back. With early toe-off ground clearance can be aided through the action of hip flexion. Since the rectus femorus' action of hip flexion only takes place with the knee extended, at the time toe-off is taking place, the knee is flexed. The remaining muscles available to flex the hip include the Iliacus and the Psoas major. Iliacus pain generally can be felt along its origin along the crest of the ilium. It is the use of these muscles out of sequence that possibly lead to the creation of low back symptoms and pain in the groin relative to the inability of the great toe to extend.

VERTICAL TOE-OFF WITH SECONDARY BIPEDAL STANCE

If hallux extension is not available then vertical toe-off and prolonged bipedal stance can be a compensation. The entire foot can be lifted vertically off the supporting surface leading to total reduction in the creation of longitudinal shear and therefor marked decrease in velocity. Forward progression is accomplished through apropulsive-type gait mechanics. The patient bends at the waist and neck leaning ahead of his foot position. This action causes a forward progression of the body center of mass and the foot is lifted vertically off the ground and advanced in an anterior direction to catch up to the body center of mass. Since the method of forward progression does not effectively use momentum, it becomes an extremely inefficient method of propulsion with high energy expenditure noted. In addition, the speed with which ambulation can take place is markedly decreased. In Herman's text "Neural Control Of Locomotion" the following is described: "When walking speed is reduced to the point when stability is threatened both nornmal subjects and patients systematically increased their radio of double support period to stride period and consequently rely on more bipedal contact for control." This appears to be extremely true in geriatrics when bipedal stance during gait occurs and shuffling of the feet increases.

SYMPTOMS

Symptoms for this particular compensation include quadricep pain, pain in the lower back and decreased stability during walking. This compensation appears to take place predominantly in the geriatric population although it definitely is not exclusive to that group.

SUMMARY

It can be seen that a condition that exists in the human foot may lead to a variety of painful symptoms and gait abnormalities yet itself remain asymptomatic. It can in some ways be thought of as a catalyst for the symptoms and conditions described. Further work needs to be done to more accurately describe other symptoms and compensations of this fascinating gait abnormality.

While numerous embodiments of the invention have been described above, other forms thereof will be apparent to one of ordinary skill in the art.

I claim:

1. A human shoe sole having a foot supporting upper surface, a portion of said sole, extending from said upper surface into said sole and underlying substantially only the location of the first metatarsal head of a wearer's foot, being of reduced support relative to the remainder of said sole to provide less resistance to downward motion than the remainder of said surface to facilitate eversion and plantarflexion of said metatarsal head, wherein said portion does not extend forward of said first metatarsal head.

2. A human shoe sole according to claim 1, wherein said portion of reduced support is softer than the remainder of said sole.

3. A human shoe sole according to claim 2 wherein said portion of reduced support comprises an opening formed in said sole and extending from said upper surface with a plug of material softer than the remainder of the surface fitted therein.

4. A human shoe sole according to claim 1, wherein said portion of reduced relative support comprises an opening formed in said sole and extending from said upper surface.

5. A human shoe sole according to claim 4, said portion of said sole being formed to permit said first metatarsal head freely to plantarflex under load, said area being arranged so that resistance to eversion decreases as resistance to inversion of the first metatarsal head increases thus permitting and encouraging the first metatarsal to evert and plantarflex as weight of the wearer shifts from the heel to the toe during walking.

6. A human shoe sole according to claim 1, wherein the effective support of said portion varies from maximum reduction of support under the medial (inside) portion of the first metatarsal head to a minimum reduction of support under the lateral (outside) portion of said metatarsal head.

7. A human shoe sole according to claim 6, wherein the variation of effective support is due to a larger size of the area of maximum reduction under the impact point of the medial portion relative to the area under the impact point of the lateral portion of the first metatarsal head.

8. A human shoe sole according to claim 1, wherein the effective support of said portion varies from a maximum reduction of support under the impact point of the medial portion of first metatarsal head of the wearer during plantarflexion to a minimum reduction of support.

9. A human shoe sole according to claim 8, wherein the variation of effective support is due to a larger size of the area of maximum reduction under the impact point of the medial portion relative to the area under the impact point of the lateral portion of the first metatarsal head.

10. A human shoe sole to facilitate downward motion of the first metatarsal head, of a human foot supported by said sole, relative to the rest of said foot to promote eversion and plantarflexion of said first metatarsal head, said sole having an upper surface for supporting said foot, a portion of said sole extending downward from said upper surface and underlying said first metatarsal head being of reduced support relative to the remainder, including those portions under the other metatarsal heads and the entire hallux, of the sole.

11. A human shoe incorporating a shoe sole having a foot supporting upper surface, wherein, except for a portion of the sole extending downward from said upper surface and underlying the first metatarsal head, the sole throughout, including the portions thereof underlying the second through fifth metatarsal heads and the entire hallux of a wearer's foot, provides greater support than does said portion, thereby to encourage downward motion of said first metatarsal head to promote eversion and plantarflexion thereof.

12. A human shoe sole having means to facilitate downward motion of the first metatarsal head relative to the rest of a human foot, when supported by said sole, to promote eversion and plantarflexion of said first metatarsal head, said sole having first and second zones which together define an upper surface to support said foot, said means comprising said first zone being a portion of said sole, extending downward from said upper surface and underlying said first metatarsal head of said foot, of reduced support relative to the support provided by the second zone, said second zone including those portions of the sole under the other metatarsal heads and under the entire hallux.

13. A human shoe incorporating a shoe sole having a foot supporting upper surface consisting of first and second zones, the second zone including the portions thereof underlying the second through fifth metatarsal heads and the entire hallux of a wearer's foot, the first zone comprising a portion of the sole extending from said upper surface into said sole and underlying the first metatarsal head, said first zone being less supportive than said second zone thereby to encourage downward motion of said first metatarsal head to promote eversion and plantarflexion thereof.

* * * * *

UNITED STATES PATENT AND TRADEMARK OFFICE

CERTIFICATE OF CORRECTION

PATENT NO. : 4,597,195

DATED : July 1, 1986

INVENTOR(S) : Howard J. DANANBERG, D.P.M.

It is certified that error appears in the above—identified patent and that said Letters Patent is hereby corrected as shown below:

Claim 1, line 57, insert --first-- before "metatarsal".

Signed and Sealed this

Twentieth Day of January, 1987

*Attest:*

DONALD J. QUIGG

*Attesting Officer*

*Commissioner of Patents and Trademarks*

US004597195C1

(12) REEXAMINATION CERTIFICATE (4717th)

United States Patent

Dananberg

(10) Number: US 4,597,195 C1

(45) Certificate Issued: Jan. 14, 2003

(54) HUMAN SHOE SOLE

(75) Inventor: Howard J. Dananberg, Manchester, NH (US)

(73) Assignee: Davis & Soloway, Manchester, NH (US)

Reexamination Request:
No. 90/005,839, Oct. 5, 2000
No. 90/005,955, Mar. 19, 2001

Reexamination Certificate for:

| | |
|---|---|
| Patent No.: | **4,597,195** |
| Issued: | **Jul. 1, 1986** |
| Appl. No.: | **06/598,712** |
| Filed: | **Apr. 11, 1984** |

Certificate of Correction issued Jul. 1, 1986.

(51) Int. Cl.[7] ..... A43B 13/18
(52) U.S. Cl. ..... 36/28; 36/43
(58) Field of Search ..... 36/31, 43, 44, 36/25 R, 28, 30 A, 30 R, 32 R, 88, 93, 95, 103

(56) References Cited

U.S. PATENT DOCUMENTS

| | | | |
|---|---|---|---|
| 73,924 | A | 1/1868 | Pickett |
| 975,576 | A | 11/1910 | Sexton |
| 1,055,768 | A | 3/1913 | Levee et al. |
| 1,137,092 | A | 4/1915 | Sharp |
| 1,210,066 | A | 12/1916 | Hara |
| 1,387,952 | A | 8/1921 | Steinbrecher |

(List continued on next page.)

FOREIGN PATENT DOCUMENTS

| | | |
|---|---|---|
| DE | 22803 | 6/1883 |
| DE | 660551 | 3/1938 |
| DE | 875466 | 7/1949 |
| DE | 397 602 B | 5/1994 |
| EP | 427556 | 5/1991 |
| EP | 591909 | 10/1993 |
| FR | 1163646 | 9/1958 |
| FR | 1207258 | 2/1960 |
| FR | 1413280 | 4/1965 |
| FR | 2015914 | 4/1970 |
| FR | 2272618 | 3/1975 |
| FR | 2309169 | 5/1975 |
| FR | 2 427 801 | 6/1978 |
| FR | 2506132 | 5/1981 |
| FR | 2522482 | 1/1982 |
| GB | 217833 | 6/1924 |
| GB | 452492 | 11/1934 |
| GB | 1243575 | 8/1971 |
| GB | 1 564 195 | 4/1980 |
| GB | 2057964 | 4/1981 |
| GB | 2088776 | 6/1982 |

OTHER PUBLICATIONS

"Podopediatrics—The Care of Childrens Feet" by Herman R. Tax, B.S.,Pod.D., Copyright 1947 ("Manual"), Pgs. forward and 101–110.

*A Manual of Lower Extremities Orthotics,* ed. Miles H. Anderson, pp. 109–111, 1972.

*Common Foot Disorders: Diagnosis and Management,* ed. Donald Neale, pp. 44–47, 52–54, 65–66, 192–194, 1981.

*Mechanical Foot Therapy,* Philip R. Brachman (The Leicht Press) pp. 292–295, 1946.

*Lower Limb Orthotics: 1981 Revision,* Prosthetics and Orthotics Department, New York University, Post–Graduate Medical School, pp. 172–179, copyright 1981.

Herman R. Tax, D.P.M., *Podopediatrics,* 1980, pp. 189, 221–242.

Merton L. Root, D.P.M.; William P. Orien, D.P.M.; and John H. Weed, D.P.M.; *normal and abnormal Function Of The Foot,* 1977, Clinical Biomechanics, vol. II, pp. 355–367.

*Primary Examiner*—Anthony Stashick

(57) ABSTRACT

A human shoe sole has a foot engaging surface, that area of the sole immediately underlying the first metatarsal head being designed so that the first metatarsal head is free to plantarflex under load thus permitting and encouraging the first metatarsal to plantarflex as weight shifts from the heel to the toe during walking.

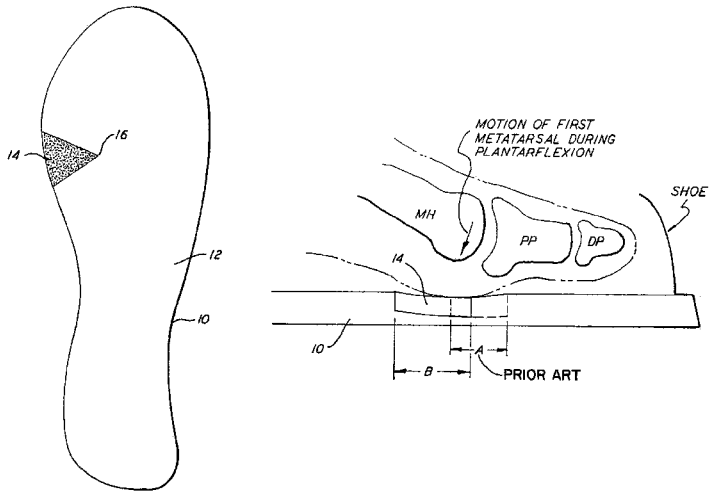

U.S. PATENT DOCUMENTS

| | | | |
|---|---|---|---|
| 1,480,234 | A | 1/1924 | Wedd |
| 1,544,625 | A | 7/1925 | Austin |
| 1,557,312 | A | 10/1925 | Lelyveld |
| 1,728,243 | A | 9/1929 | Marshalek |
| 1,828,086 | A | 10/1931 | Tweedie |
| 1,847,973 | A | 3/1932 | Morton |
| 1,957,695 | A | 5/1934 | Chiapetta |
| 1,960,418 | A | 5/1934 | Schaller |
| 1,992,081 | A | 2/1935 | Madinger |
| 2,008,207 | A | 7/1935 | Greenberg |
| 2,029,409 | A | 2/1936 | Brand |
| 2,034,463 | A | 3/1936 | Dvlinsky |
| 2,046,732 | A | 7/1936 | Fein |
| 2,055,072 | A | 9/1936 | Everston |
| 2,081,474 | A | 5/1937 | Burns |
| 2,097,759 | A | 11/1937 | Ehrlich |
| 2,119,807 | A | 6/1938 | Farley |
| 2,156,532 | A | 5/1939 | Greider |
| 2,161,565 | A | 6/1939 | Freda |
| 2,252,936 | A | 8/1941 | Leydecker |
| 2,255,100 | A | 9/1941 | Brady |
| 2,346,279 | A | 4/1944 | Stritter |
| 2,379,000 | A | 6/1945 | Gould |
| 2,413,534 | A | 12/1946 | Watson |
| 2,423,622 | A | 7/1947 | Samblanet |
| 2,424,107 | A | 7/1947 | McCahan |
| 2,460,493 | A | 2/1949 | Diamant |
| 2,505,032 | A | 4/1950 | De Voos |
| 2,628,440 | A | 2/1953 | Leydecker |
| 2,658,288 | A | 11/1953 | Scholl |
| 2,814,133 | A | 11/1957 | Herbst |
| 2,821,032 | A | 1/1958 | Helfet |
| 2,828,555 | A | 4/1958 | Ledos |
| 2,863,231 | A | 12/1958 | Jones |
| 2,897,611 | A | 8/1959 | Schaller |
| 2,909,854 | A | 10/1959 | Edelstein |
| 2,917,849 | A | 12/1959 | Scholl |
| 2,928,193 | A | 3/1960 | Kristan |
| 2,961,780 | A | 11/1960 | McManus |
| 3,068,872 | A | 12/1962 | Brody |
| 3,099,267 | A | 7/1963 | Cherniak |
| 3,165,841 | A | 1/1965 | Rollman |
| 3,187,069 | A | 6/1965 | Pincus et al. |
| 3,233,348 | A | 2/1966 | Gilkerson |
| 3,309,797 | A | 3/1967 | Poitras |
| 3,333,353 | A | 8/1967 | Garcia |
| 3,416,245 | A | 12/1968 | Ferreira |
| 3,449,844 | A | 6/1969 | Spence |
| 3,530,489 | A | 9/1970 | Appleton |
| 3,591,882 | A | 7/1971 | Pearsall |
| 3,638,336 | A | 2/1972 | Silverman |
| 3,643,353 | A | 2/1972 | Weight |
| 3,730,169 | A | 5/1973 | Fiber |
| 3,781,231 | A | 12/1973 | Janssen et al. |
| 3,842,519 | A | 10/1974 | Lapidus |
| 3,847,720 | A | 11/1974 | Laberinti |
| 3,935,044 | A | 1/1976 | Daly |
| 4,003,146 | A | 1/1977 | Meier et al. |
| 4,054,706 | A | 10/1977 | Shapiro |
| 4,055,699 | A | 10/1977 | Hsiung |
| D246,551 | S | 12/1977 | Hansjosten et al. ..... D2/320 |
| 4,084,333 | A | 4/1978 | Del Vecchio |
| 4,101,704 | A | 7/1978 | Hiles |
| 4,124,946 | A | 11/1978 | Tomlin |
| 4,128,950 | A | 12/1978 | Bowerman et al. |
| 4,137,654 | A | 2/1979 | Hlavac |
| 4,168,585 | A | 9/1979 | Gleichner |
| 4,187,621 | A | 2/1980 | Cohen |
| 4,188,736 | A | 2/1980 | Keller |
| 4,235,026 | A | 11/1980 | Plagenhoff |
| 4,240,214 | A | 12/1980 | Sigle et al. |
| 4,266,350 | A | 5/1981 | Laux |
| 4,268,980 | A | 5/1981 | Gudas |
| 4,272,899 | A | 6/1981 | Brooks |
| 4,285,144 | A | 8/1981 | Power |
| 4,292,263 | A | 9/1981 | Hanrahan et al. |
| 4,296,053 | A | 10/1981 | Doerer et al. |
| 4,302,892 | A | 12/1981 | Adamik |
| 4,307,521 | A | 12/1981 | Inohara et al. |
| 4,316,335 | A | 2/1982 | Giese et al. |
| 4,345,387 | A | 8/1982 | Daswick |
| 4,346,205 | A | 8/1982 | Hiles |
| 4,346,525 | A | 8/1982 | Larsen et al. |
| 4,360,027 | A | 11/1982 | Friedlander et al. |
| 4,364,189 | A | 12/1982 | Bates |
| 4,372,059 | A | 2/1983 | Ambrose |
| 4,377,041 | A | 3/1983 | Alchermes |
| 4,378,642 | A | 4/1983 | Light et al. |
| 4,398,357 | A | 8/1983 | Batra |
| 4,408,402 | A | 10/1983 | Looney |
| 4,418,483 | A | 12/1983 | Fujita et al. |
| 4,435,910 | A | 3/1984 | Marc |
| 4,455,340 | A | 6/1984 | Okina |
| 4,472,890 | A | 9/1984 | Gilbert |
| 4,490,928 | A | 1/1985 | Kawashima |
| 4,494,321 | A | 1/1985 | Lawlor |
| 4,506,462 | A | 3/1985 | Cavanagh |
| 4,510,700 | A | 4/1985 | Brown |
| 4,510,702 | A | 4/1985 | Ehrlich, Jr. |
| 4,513,518 | A | 4/1985 | Jalbert et al. |
| 4,515,851 | A | 5/1985 | Johnson |
| 4,517,981 | A | 5/1985 | Santopietro et al. |
| 4,527,345 | A | 7/1985 | Lopez Lopez |
| 4,541,184 | A | 9/1985 | Leighton |
| 4,541,186 | A | 9/1985 | Mulvihill |
| 4,557,060 | A | 12/1985 | Kawashima |
| 4,564,966 | A | 1/1986 | Chen |
| 4,581,187 | A | 4/1986 | Sullivan et al. |
| 4,586,273 | A | 5/1986 | Chapnick |
| 4,627,177 | A | 12/1986 | Meyers |
| 4,627,178 | A | 12/1986 | Sullivan et al. |
| 4,674,204 | A | 6/1987 | Sullivan et al. |
| 4,677,766 | A | 7/1987 | Gudas |
| 4,769,926 | A | 9/1988 | Meyers |
| 4,777,739 | A | 10/1988 | Hiles |
| 4,782,605 | A | 11/1988 | Chapnick |
| 4,798,010 | A | 1/1989 | Sugiyama |
| D302,764 | S | 8/1989 | Peoples et al. ..... D2/318 |
| 4,854,057 | A | 8/1989 | Misevich et al. |
| 4,910,886 | A | 3/1990 | Sullivan et al. |
| D362,956 | S | 10/1995 | Martin et al. ..... D2/961 |
| 5,787,610 | A | 8/1998 | Brooks |

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *